US005143504A

United States Patent [19]

Braakman

[11] Patent Number: 5,143,504

[45] Date of Patent: Sep. 1, 1992

[54] METHOD OF MANUFACTURING A SEAM CONNECTION

[75] Inventor: Gerleen H. Braakman, Soest, Netherlands

[73] Assignee: Koninklijke Emballage Industrie Van Leer B.V., Amstelveen, Netherlands

[21] Appl. No.: 758,308

[22] Filed: Aug. 28, 1991

Related U.S. Application Data

[63] Continuation of Ser. No. 440,763, Sep. 18, 1989, abandoned.

[30] Foreign Application Priority Data

Sep. 21, 1988 [NL] Netherlands ..... 8802339

[51] Int. Cl.[5] ..... B21D 51/32

[52] U.S. Cl. ..... 413/6; 413/7

[58] Field of Search ..... 413/4–7, 413/31, 35, 36

[56] References Cited

U.S. PATENT DOCUMENTS 2,101,530 12/1937 Brenzinger .
4,055,271 10/1977 Kronenwetter et al. ..... 413/4

FOREIGN PATENT DOCUMENTS 0177426 4/1986 European Pat. Off. .
3705878 9/1987 Fed. Rep. of Germany .
1403163 5/1965 France .
0072735 5/1982 Japan ..... 413/6
0035027 3/1983 Japan ..... 413/6
1153872 5/1969 United Kingdom .
1325706 8/1973 United Kingdom .
2109777 6/1983 United Kingdom ..... 413/4
2202777 10/1988 United Kingdom .
WO85/05299 12/1985 World Int. Prop. O. .

*Primary Examiner*—Bruce M. Kisliuk
*Assistant Examiner*—Jack Lavinder
*Attorney, Agent, or Firm*—Young & Thompson

[57] ABSTRACT

Method of manufacturing a seam connection between body flanges (9) and end wall flanges (5) of a drum (11) by means of a seaming roller (14) which folds the flanges about eaach other, the essential difference with respect to prior art seaming operations being that the precurl (6) of the end wall flange (5), known in itself, is guided into the lower portion of the groove (15) of the seaming roller so that during the radial movement inwardly of the seaming roller (14) the flanges (5,9) may bulge outwardly in axial direction and form a so called cat's back by means of which the flanges and accordingly end wall (2) and body (1) are centered upon each other, whilst further a distance is provided between the upstanding edge (3) of the end wall (2) and the curvature (10) between body (1) and body flange (9) which distance during the seaming operation may be reduced. It moreover is possible by using a support (13) for the end wall which is smaller in diameter than the diameter of the body (1), to perform the seaming operation inwardly to a degree such that the final seam has an outer diameter which is substantially equal to the diameter of the body (1).

7 Claims, 12 Drawing Sheets

METHOD OF MANUFACTURING A SEAM CONNECTION

This application is a continuation of application Ser. No. 440,763, filed Sep. 18, 1989, now abandoned.

The invention relates to a method of manufacturing a seam connection, such as a double seam or triple seam connection, between the radially outwardly extending flange of the end edge of the body of a container and the edge flange of an end wall or cover, in which the last mentioned edge flange is provided with a curling or precurl with small radius prior to manufacturing the seam connection, the inner diameter of said precurl being larger than the diameter of the outer edge of the body flange, which flange at the location of the transition towards the body is manufactured with a curvature having a radius of a magnitude such that a gradually bent transition is obtained from the body towards the flange and the flange of the end wall merges into the end wall by a curvature, which flanges after placing and axial pressing an end wall and body upon each other are rolled into each other with the aid of at least one seaming roller having a groove, which roller is displaced in circumferential direction with respect to the body and radially towards the body to perform the rolling into each other of the flanges inside the groove of the seaming roller with simultaneous centering and supporting of the end wall on the innerside of the flange of the end wall, the groove of the seaming roll or roller having a height, which is larger than the thickness of the precurl measured in a direction parallel to the axis of the body.

Such a method is known from UK patent specification 1,325,706. Said known method deals with the manufacturing of a triple seam, providing the edge of the flange of the end wall with an open precurl of substantially 180°, which precurl may be provided with a sealing compound. The flange of the end wall joins the upstanding edge of the end wall by means of a small curvature such that an angle of 90° is obtained practically. The flange of the end edge of the body joins the body with a large curvature and the outer edge of the body flange lies inside the inner diameter of the inwardly turned edge of the precurl of the end wall flange. During seaming the edge of the body flange enters the precurl, fixes itself therein, whereby during the folding or seaming the large curvature of the flange of the end edge of the body provides the space necessary to obtain a well closed triple seam connection.

The method known from said British patent specification 1,325,706 forms an improvement of the method known from British specification 1,153,872 described as well in said publication, which last mentioned method is characterized in that the curvatures of the end wall flange with the upstanding edge and of the body flange with the body respectively fit into each other to center the end wall and the body upon each other. The end wall flange is given a small precurl of less than 180° which precurl in the beginning of the seaming operation is curled further until it engages over the edge of the body flange after which during continuation of the seaming both flanges are rolled into each other during which the edges of the flanges shift upon each other.

In both cases end wall and body are centered upon each other at the location of the upstanding edge of the end wall.

Said known methods have problems, because the parts which have to be interconnected during seaming in circumferential direction of the container have differences in configuration as well as measure deviations due to tolerances. This leads to excentricity and swinging movements during seaming. If in the beginning of the seaming deviations occur then a seam is formed which, seen in circumferential direction, is of irregular quality. In case said deviations in measure lead to an excentric placing of end wall and body with respect to each other then, in case end wall and body are clamped upon each other, the seaming rollers themselves will not be capable to correct the excentricity. The swinging and irregularity of the seam connection in circumferential direction accordingly is maintained.

A further problem of the known method is, that body and end wall are placed in each other outside the seaming machine so that as a result of the then still loose relation loosening of the end wall can take place or excentric placing of the end wall inside the body can occur respectively. With containers obtained with the known methods the seam connection lies radially outside the outer diameter of the body. This leads to a larger outer diameter which in certain cases is unfavourable for transportion of a plurality of containers in a normalized transportation container.

Several proposals are known for pressing the seam connection further radially inwardly. An example is found in the published Dutch patent application 7208083. After manufacturing the seam connection the seam is reduced from its largest diameter towards a smaller diameter.

During further pressing of the seam radially inwardly to obtain an outer diameter at the location of the seam which is not or hardly larger or smaller than the largest diameter of the body, the angle between the upstanding edge of the end wall and the end wall itself is deformed into a sharp angle. This has a negative influence upon the vibration resistance of body or end wall. Moreover the risk exists that the normally present convexity of the end wall or cover disappears or changes into an inwardly turned concavity.

A method for simultaneously forming the seam and reducing the body diameter adjacent to the seam is known as well from the published European patent application 0 177 426.

Centering between body and the upstanding edge of the end wall therewith is obtained by providing one of them with a profile. Said profile forms an additional complication in the manufacturing process due to its shape and the high precision required.

Moreover the proposed method only allows a restricted reduction of the diameter of the seam and a diameter of the seam which is substantially equal to the outer diameter of the body as may be desired for the transportation of containers in a standard transport container, certainly cannot be obtained.

Purpose of the invention is to provide a method for the manufacturing of a seam connection in which the above described problems do no longer exist, which is more simple, more safe in operation and more economical and which moreover contains the possibility to be capable to make the diameter of the seam connection smaller than the diameter of the body without the objections of the known method.

This purpose is in the first place achieved according to the invention in that a distance is provided between the upstanding edge of the end wall and the curvature of the transition between body and its flange and that the precurl in the beginning of the seaming operation is guided in that portion of the groove of the seaming roller which, seen in axial direction, is more close to the center of the body.

A method is preferred in which during seaming the end wall is supported by a surface extending around the axis of the body, the largest diameter of which is smaller than the diameter of the body, to an extent such that a reduction of the diameter of the body adjacent to the seam takes place.

According to the invention a clearance is intentionally generated between the body and the upstanding portion of the end wall. The diameter of the body flange as with the method known from the British specification 1,325,706 lies inside the inner diameter of the precurl due to which in certain cases to be described later a certain centering may be obtained during placing of end wall and body upon each other.

By starting the seaming, different from what has been common practice so far, in a different part of the groove of the seaming roller, the flanges of end wall and body will be bent outwardly in the beginning of the seaming by the combination of the radial force, performed by the seaming roller, and the axial force derived from the clamping of the body within the seaming machine. Said flanges form so to say, seen in cross section, a cat's back. By the clamping force by means of which the curving flanges are pressed upon each other, body and end wall are well centered upon each other and remain centered during the further seaming. During said seaming the cat's back shaped curvature takes care that the plate edges roll well into each other, whilst simultaneously the free forming seam connection moves axially outwardly and radially inwardly due to which the upstanding edge of the end wall obtains a larger height, which height is limited by the other plane of the groove of the seaming roller, whereas the resulting outer diameter of the seam is defined by the diameter chosen for the support of the end wall plus a little bit more than two times the thickness of the seam.

In some cases it is preferred to provide the end wall flange with a precurl which is practically closed. This can promote the centering of body and end wall upon each other, whereas due to the cat's back shaped curvature occurring at the beginning of the seaming operation the precurl will open so that the edge of the body flange may enter.

It moreover is useful to provide the edge of the body flange with an outer diameter which is substantially equal to or a little bit smaller than the inner diameter of the precurl such that placing into each other in axial direction is possible. Due to the fact that the body always is somewhat oval a kind of snap connection occurs, so that body and end wall are centered upon each other with the oval shape being pressed away by the clamping. Therewith one obtains a location of end wall and body with respect to each other, prior to seaming, so that end wall and body remain together during transportation in the manufacturing line.

The method according to the invention accordingly differs from all known methods by manufacturing a seam connection in which centering no longer takes place between body and upstanding edge of the end wall, but substantially halfway the radial length of the end wall flange, adjacent to or at a location of the precurl, which centering in the beginning still allows some shifting at the moment the cat's back starts to form, but is absolute as soon as the diameters of precurl and body flange, seen in the plane of the end wall, are substantially equal to each other. The method according to the invention moreover differs from the known methods in that seaming starts in that part of the groove of the seaming roller which lies opposite that part in which seaming normally starts. With the known methods the groove of the seaming roller functions such, that its surface upon engaging the flanges follows the curving of the precurl and wants to continue this. With the method according to the invention this does indeed not occur. As soon as the precurl enters the groove, with the underside of the precurl in contact with the radial starting face of the groove, still nothing happens with the precurl. As soon as the precurl starts to engage the curved inner face of the groove, then the flanges bent towards the side where there still is space and the bulging or cat's back is obtained due to the fact that the roller moves radially inwardly. The groove of the seaming roller to this end offers space upwardly and both flanges now with simultaneous entering of the body flange into the precurl and continuation of the catback bulging are bent axially outwardly and during bending are placed against the support of the upstanding edge of the end wall due to which said edge obtains a larger height.

It has been shown that with the method according to the invention it is possible to manufacture a faultless seam connection which does not have the disadvantages of the known methods.

During simultaneously seaming of bottom and cover the first one third part of the seaming operation is critical. Apart from the already mentioned tolerances, differences in slipperiness between the contact faces of the two flanges of end wall and body may already have as a result that the body flange at one side of the container is folded more than at the other side, with as result differences in quality of the seam connection seen in its circumferential direction. This in particular holds true if bottom and cover are mounted simultaneously. By the centering function of the so called "cat's back" one achieves that during the critical first one third of the seaming operation equal conditions are present on both sides of the body with the useful effect that a faultless seam connection is obtained on both sides, which means at bottom and cover.

In case the precurl is closed then this can assist the centering.

Said closed precurl opens during the forming of the cat's back, so that the edge of the body flange may enter therein.

In case the precurl is not closed and one starts accordingly from a still open precurl, known in itself, then body flange and end wall flange are rigidly pressed upon each other and the bulging or cat's back occurs immediately in the beginning of the seaming. By said bulging a centering is obtained such that the final seam connection is better than the one obtained with the known method.

According to the invention the height of the upstanding edge of the end wall is defined by the height of the upstanding edge to be achieved less the height of the groove of at least the first seaming roller and plus the thickness of the precurl. A certain tolerance in positive as well as in negative sense is possible therewith.

By the fact that body and end wall no longer are centered upon each other at the location of their transition towards the flanges, but are centered by the forming of the cat's back, there may be difference between the diameter of the body and the diameter of the upstanding edge of the end wall. This means that the support of the upstanding edge and accordingly the upstanding edge itself can be given a diameter which is smaller than the diameter of the body due to which during seaming the seam obtained at the end of the operation is brought at a diameter which is smaller than usual and which therewith may end at an outer diameter of the seam connection which hardly differs from the outer diameter of the body. Preferably the transition of the end wall flange towards the upstanding edge of the end wall is therewith given a radius of curvature which is larger than usual but still smaller than the one of the curvature at the location of the transition of the flange of the body towards the body. The space obtained in this way and the axial lengthening occurring during seaming of the upstanding edge of the end wall flange with material from the flange allow further inwardly seaming and accordingly reducing of the seam diameter with the surprising effect that part of the body present close to the seam can be reduced over a considerable distance without the presence of a tool at the innerside of the body which in radial direction supports the body material at the innerside, which is the case with known rotating reduction of the body.

A further surprisingly obtained effect is that the above described disadvantage of forming a small radius of the transition between the flat part of the end wall and the upstanding part of the end wall not only is taken away during reducing but is transferred into a advantage.

The large radius of curvature to be applied preferably between the flange of the end wall and the upstanding edge of the end wall, in combination with the considerably less depth of the end wall and in combination with the large difference in diameter between inner and outer form ring of the tool for forming the end wall, have as result, that during forming of the end wall less tensions are generated in the material than with forming of end walls by known seaming methods and considerably less tensions than with the above described method of providing the end walls with profiles.

The reduction of the tensions in the material of the end wall also have as result that the end wall of a container made according to the proposed method has a larger resistance against vibration. Due to this it is possible that the end wall can be formed more economical, which means from more thin material, without running the risk that during long distances of transportation the container starts to show cracks.

According to the invention it now moreover is possible as well to give to the upstanding edge the surface of a conical plane whilst the correspondingly conically shaped support face has to engage only part of the height of said conical plane with clearance of the end wall itself.

Therewith one obtains well centering of the end wall. Moreover end walls manufactured in this manner more easily can be separated if they are present in a stack. Due to the fact that the support leaves free the real end wall, any desired shape can be given to it such as asymmetric shapes which promote a substantially complete emptying of the container.

The centering and supporting, however, can be realized in a different manner as well, e.g. by giving the end wall a conical bulge which fits in a correspondingly shaped hollow of the support and let the flange of the end wall join the end wall at a sharp outwardly turned angle with the radial plane of the end wall and to direct the body flange parallel thereto prior to starting seaming. The end wall then has a substantially flat configuration, is centered in the middle and finds at the location of the sharp angle the bending point where during seaming the bulging or cat's back can be started with simultaneous folding of the innerside of the bulge against the support which from there extends in the form of a circumferentially extending axial plane.

The new seam connection according to the invention can be obtained as well if an outwardly turned upstanding edge is given to the end wall, in which case the support takes place at the outer surface of said edge at a distance from and outwardly of the plane of the end wall flange. Support upon the outer surface of the end wall simplifies the manufacturing process because no inner support or core is necessary which has to remove later. The forming cat's back leads to forming pleats which supports the forming of the seam connection.

The sealing in the form of sealing material can be applied previously into the precurl of the end wall flange, e.g. during the manufacturing of said precurl. This can occur by spraying sealing material into it of a composition which can be cured or not and which is known in itself, or by applying a ring or wire of sealing material.

It is possible as well to operate with a substantially open precurl and with a sealing material which not only is present in the precurl but also against the inner surface of the end wall flange. The edge of the body flange entering the precurl will divide said sealing material then into two parts one of which forming the core and the other being placed between the sheet layers.

Accordingly with the method according to the invention it is possible as compared with the known methods to obtain a seam connection in a simple and accordingly more economic way because there is only one operation necessary, which seam connection has a better quality and moreover allows reduction of the diameter of the seam connection to a diameter which is smaller than the diameter of the body without the disadvantages which normally were connected to this.

The invention now will be further elucidated with reference to the drawings.

FIG. *7a,b* and *c* show in cross section an embodiment for a triple seam, a double seam and a seam of seven layers respectively with the outer diameter of the seam substantially equal to the outer diameter of the body.

Figure 8:
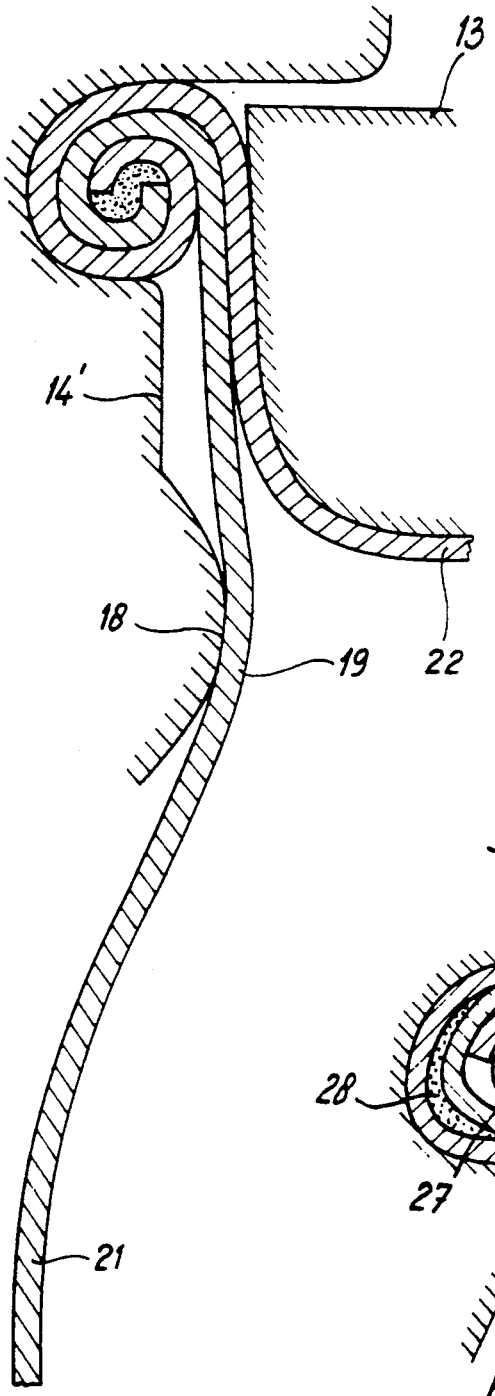

FIG. 8 shows an alternative in which the body part adjacent to the seam is deformed.

FIGS. 9,10,11,12 and 13 show further alternatives of the method according to the invention.

Figure 14:
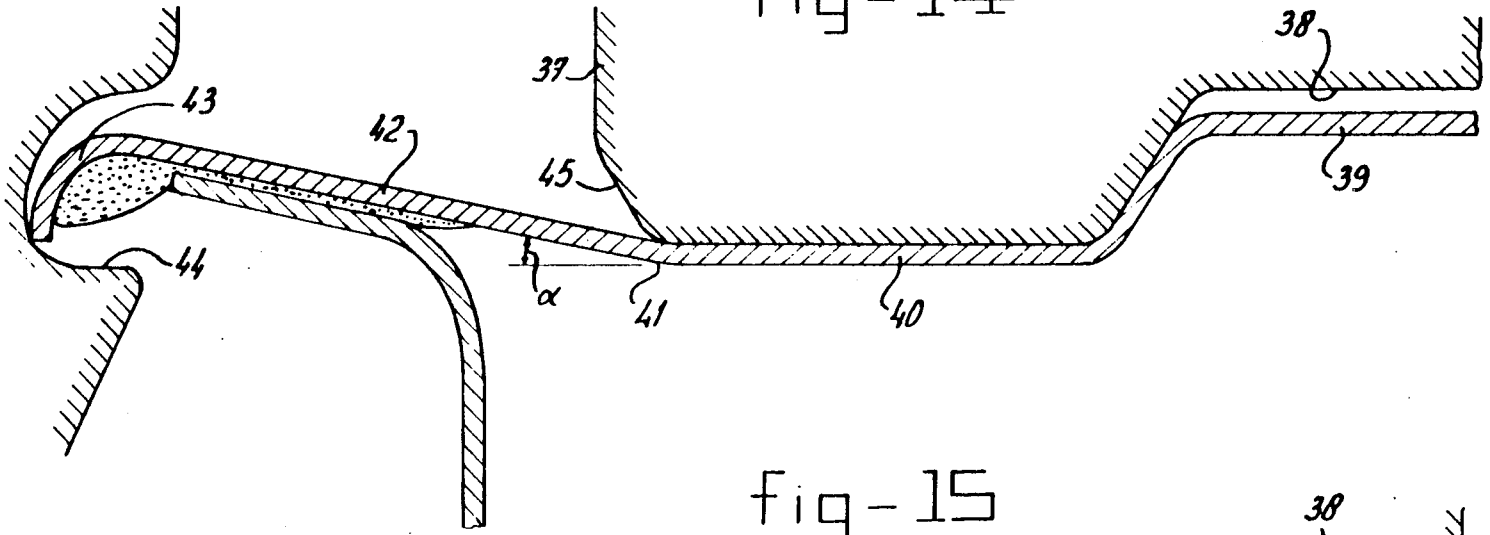
Figure 15:
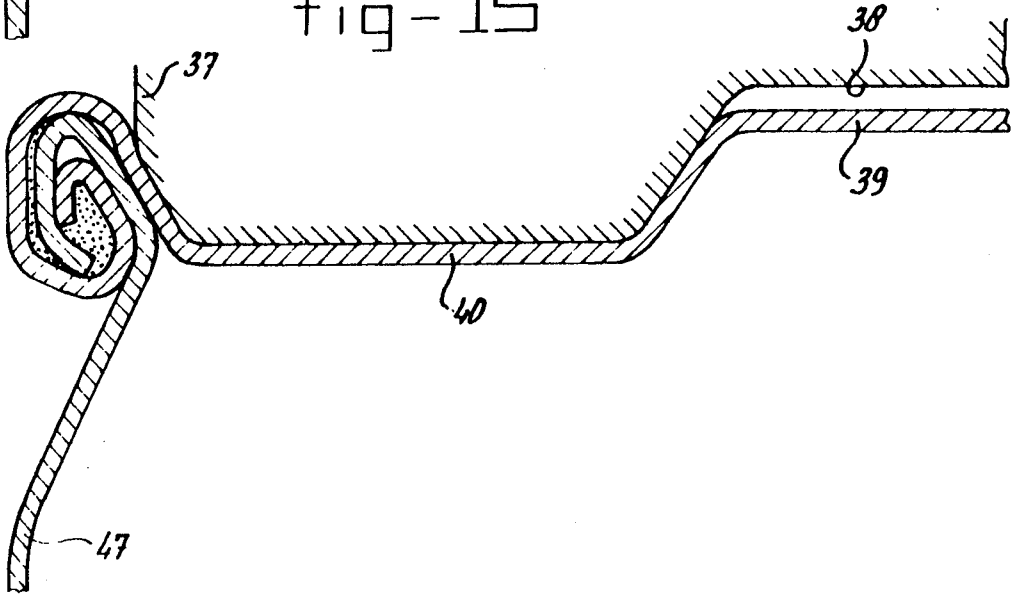

FIGS. 14 and 15 still show another alternative and

FIGS. 16,17,18 and 19 diagrammatically show a last alternative.

In the figures the body is indicated with 1 and the end wall with 2. Said end wall has an upstanding edge 3, which through a curvature 4 merges into a radial flange 5, which at its outer end has been provided with an open precurl 6, which means a precurl of substantially 180°. A sealing material 7 has been provided in said precurl.

The upstanding edge 3 through a curvature 8 merges into the central part of the end wall 2 which in the drawing is horizontal.

The body 1 has a flange 9, which through a curvature 10 merges into the body 1, which curvature 10 has a radius which is larger than the radius of the curvature 4 of the end wall.

The outer diameter of the end edge 11 of the flange 9 of the body with this embodiment is smaller than the inner diameter of the inwardly turned edge 12 of the precurl 6, so that placing of the end wall 2 upon the body 1 can take place with some clearance.

The inner support of the end wall is indicated with 13. Said support can have the shape of a disk with a height, which is of importance for the final seam connection to be manufactured and which is smaller than the depth H of the end wall after completion of the seaming. The diameter of said support is smaller than the inner diameter of the body 1. Between the upstanding edge 3 of the end wall and the transition of the curvature 10 towards the body 1 a distance or clearance is provided.

The seaming roller is diagrammatically indicated at 14 and has a seaming groove 15 the height of which is indicated with K.

The precurl has a thickness, which is indicated with V.

According to the invention the upstanding edge 3 of the end wall should have a height D which is lower than usual and is substantially defined by $D=H-K+V$, which means that the finally to be achieved depth H is reduced with the height of the groove and added to this the thickness of the precurl.

Another important difference between the method according to the invention and the known methods resides therein that at the beginning of the seaming the precurl 6 enters into the groove 15 of the seaming roller 14 such, that said precurl first comes into contact with the lower portion of the groove 15, in particular with the lower edge.

Figure 1:
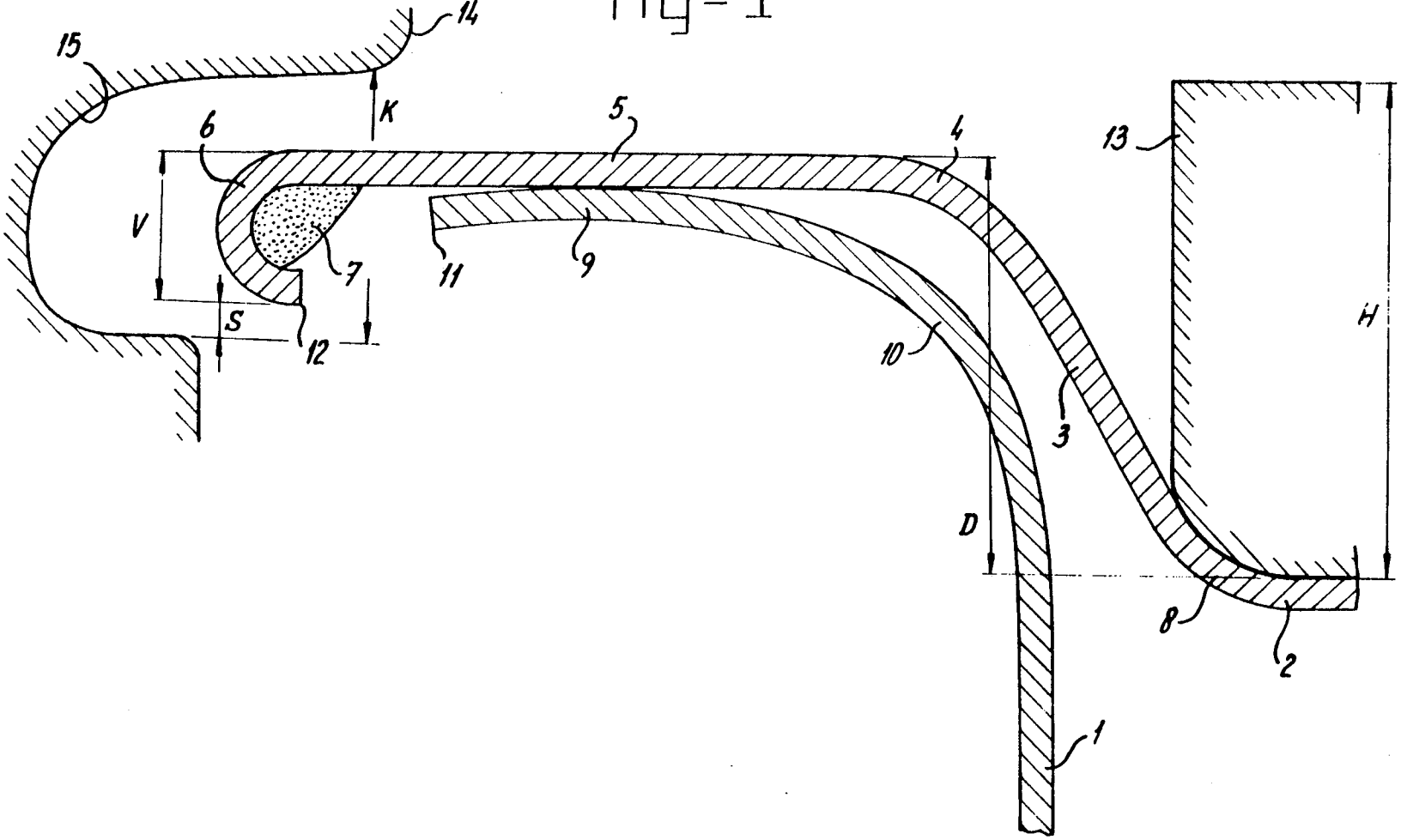
FIGS. 1 and 2 show diagrammatically in cross section the beginning and an interim face of the method according to the invention according to a first embodiment.

The difference in height positioning between the lower edge of the precurl 12 and the lower edge of the seaming roller profile 15, shown in FIG. 1 with S, can be the result of the fact, that after clamping of body and end wall in the seaming machine the flange of the end wall bends a little bit outwardly.

Figure 2:
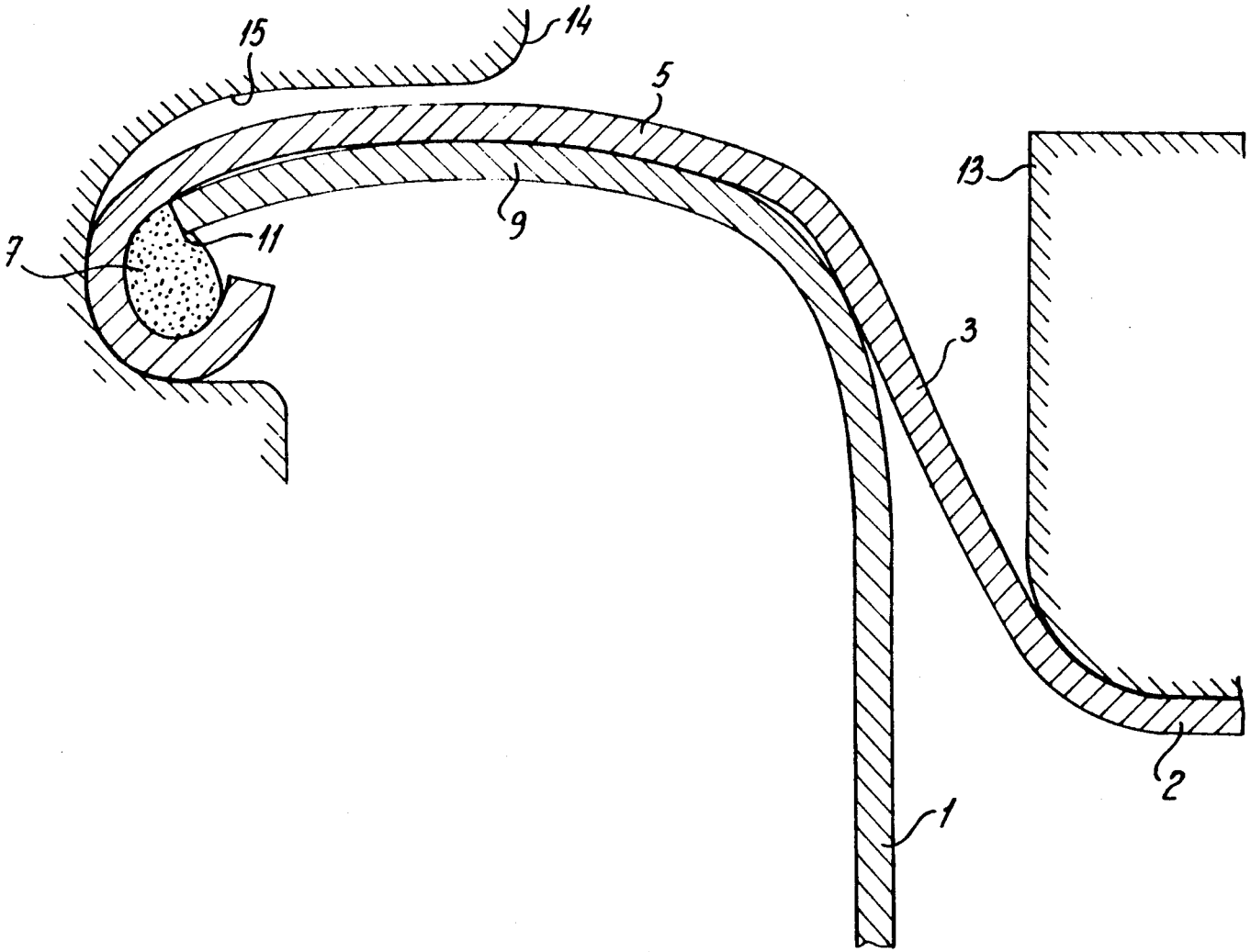

If the precurl first gets into contact with the lower part of the groove of the radially inwardly moving seaming roller (some times two are present located diametrically opposite each other) then the flange portion between precurl and curvature 4 of the end wall as well as the flange portion 9 of the body find no support in axial direction and accordingly can bulge in the manner as shown in FIG. 2.

Said bulging, mentioned as well the formation of a cat's back, means, that the flanges are pressed upon each other over a large surface, hold each other according by the shape and therewith are centered with respect to each other.

The lying against the other of flanges 9 and 5 which in the beginning (as shown in FIG. 1) still only takes place over a restricted area, grows accordingly fast and forms a formclosing engagement centering itself by the bulging, during which the edge 11 of the body flange 9 enters the precurl 6, which precurl then will close.

The engagement between the upstanding edge 3 and the further deforming curvature 10 grows up to substantially half the height of the support 13, after which further inwardly moving takes place with reduction of the outer diameter of the outer end of the body due to the fact that the support 13 has a smaller diameter.

Figure 3:
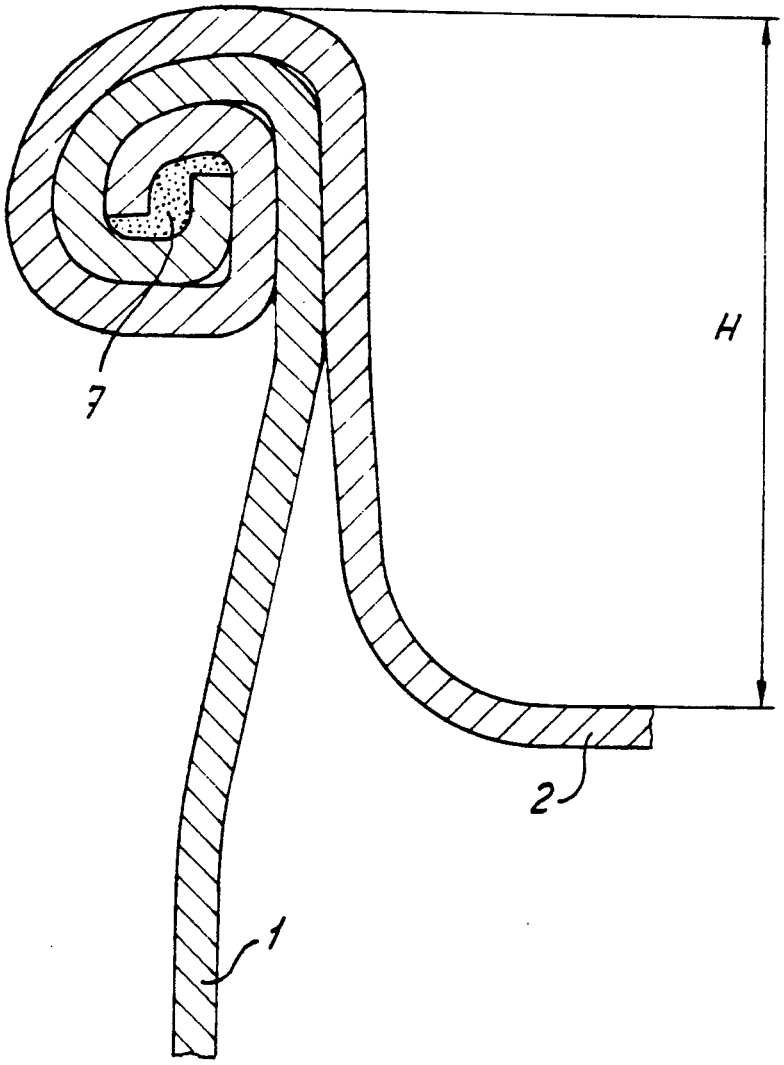
FIG. 3 shows in cross section the results obtained with said embodiment for a triple seam.

FIG. 3 shows the finally obtained form.

During seaming the finally obtained seam accordingly can be pressed inwardly somewhat beyond the diameter of the body and axially outwardly, a seam connection being formed of the triple type the center of which substantially lies at a diameter which corresponds to the diameter of the body and of which the diameter at the outer side is smaller than with a normal triple seam with no reduction of the diameter of the body.

Figure 4:
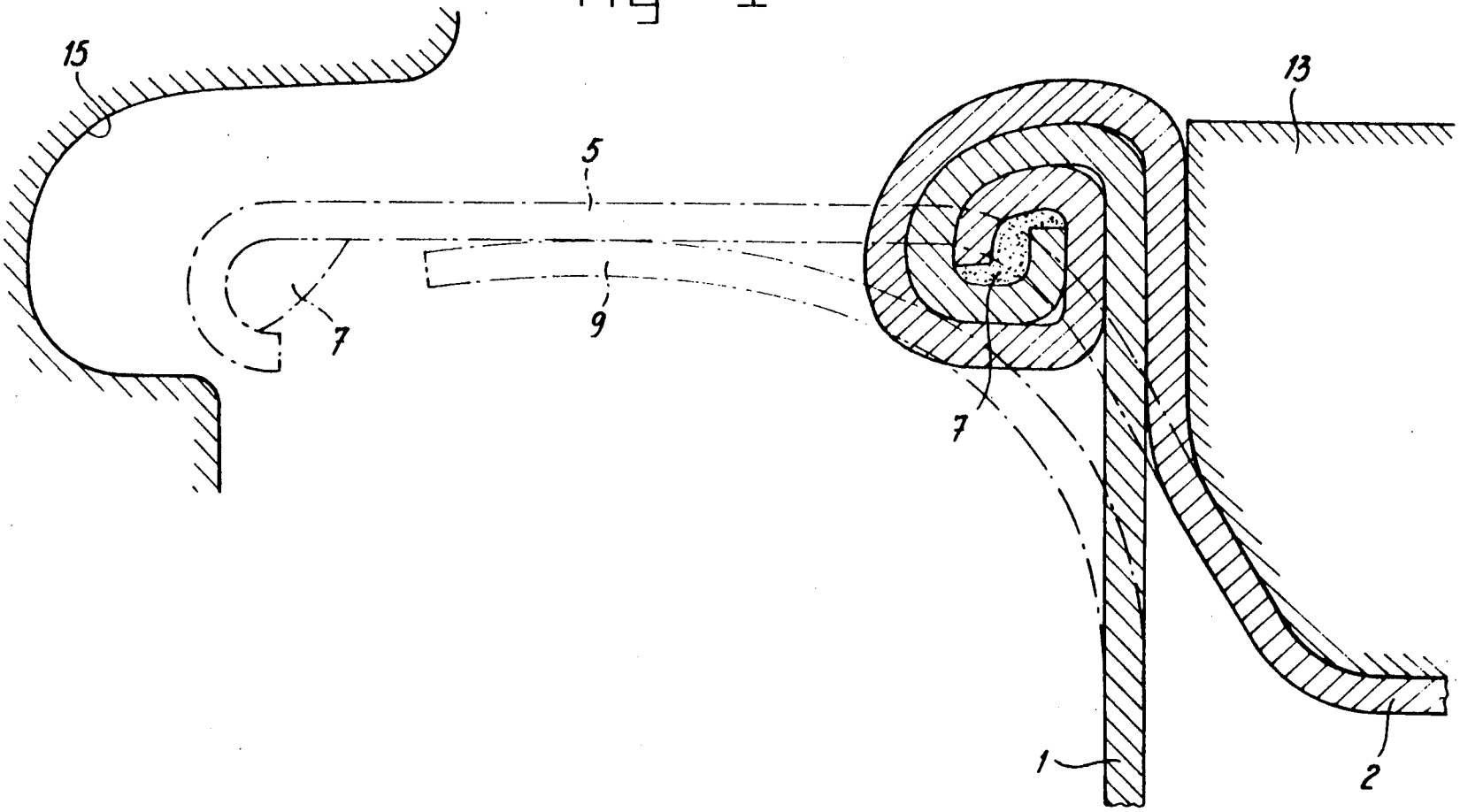
FIG. 4 shows an alternative of the method according to the invention applied for a triple seam of known form.

The principle of cat's back seaming can as well be applied, however, in a situation in which it is desirable to keep the diameter of the outer edge of the seam equal to the diameter which is obtained with a normal double or triple seam connection by applying a support of the end wall, shown in FIG. 4. The starting positions of end wall and body flanges are indicated with interrupted lines.

Figure 5:
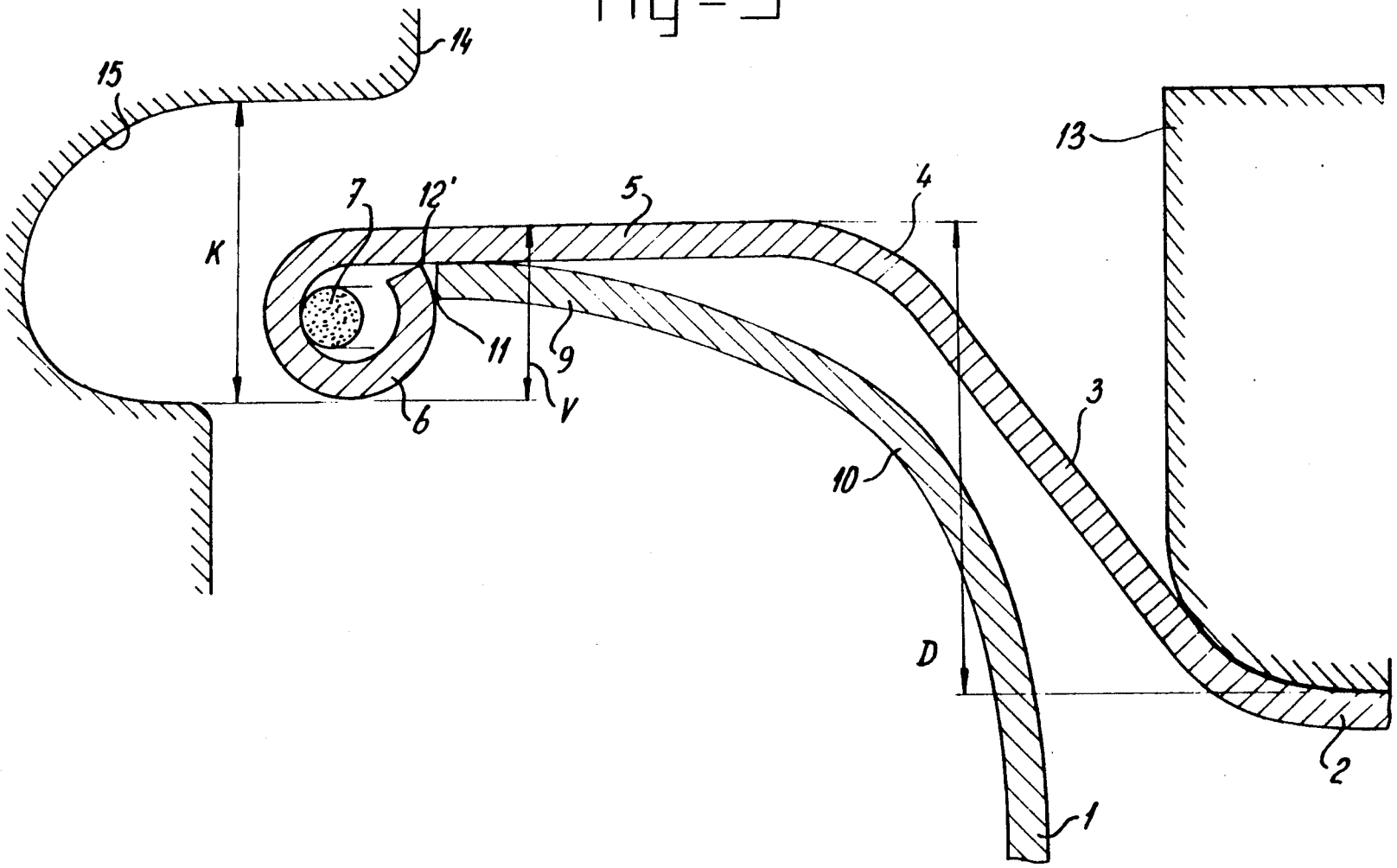
FIGS. 5 and 6 show, comparable with FIGS. 1 and 2, the beginning and interim face of the method according to the invention according to a somewhat different embodiment.
Figure 6:
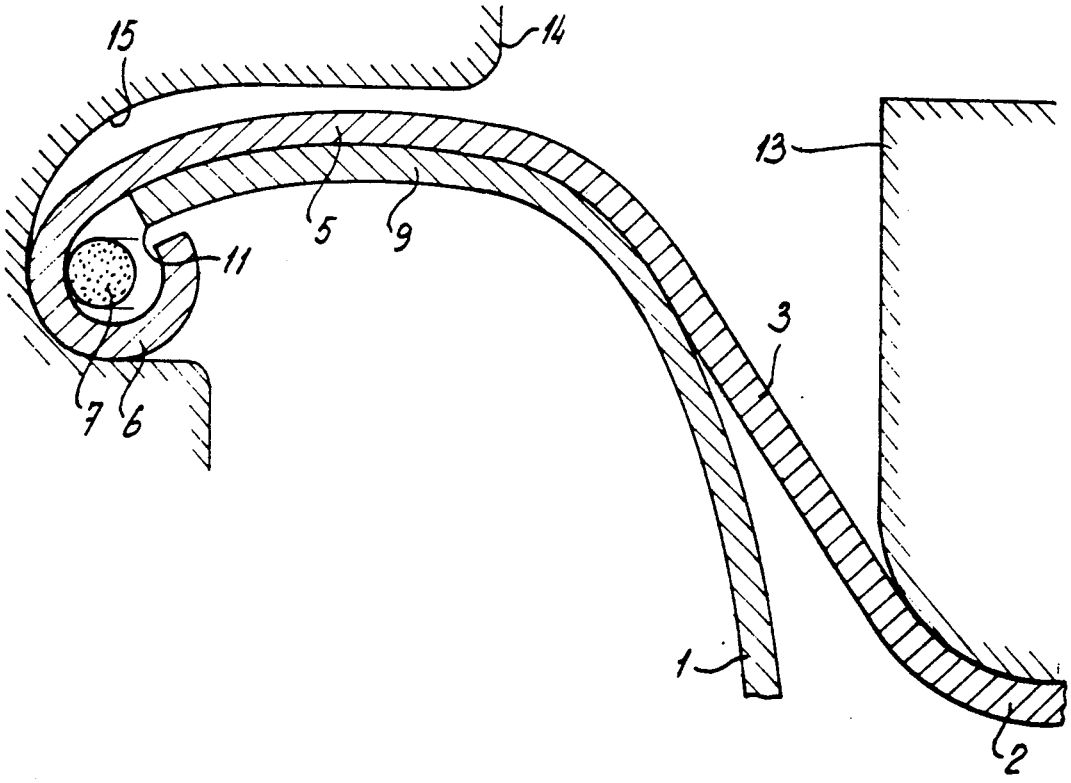

In the embodiment according to FIGS. 5 and 6 the same references are used for the parts which are the same as in FIGS. 1 and 2. The difference resides therein that the precurl 6 is closed and accordingly that its edge 12' engages or almost engages the lower side of flange 5.

A second difference resides in that the outer diameter of edge 11 of flange 9 is equal to or a little bit smaller than the inner diameter at the location of the inwardly turned curvature of the precurl 6 such that said body flange can be placed with little clearance inside the smallest diameter of the precurl.

Since there always is some ovalness, this means that the body flange will perform a snap connection at two places, due to which one achieves that end wall and body after placing upon each other do not loosen easily. Moreover one achieves a precentering.

If during seaming the bulge or cat's back is formed as shown in FIG. 6 then the precurl 6 opens and the edge 11 of the body flange may enter the curl. With this embodiment accordingly one can speak about a double centering.

Figure 7C:
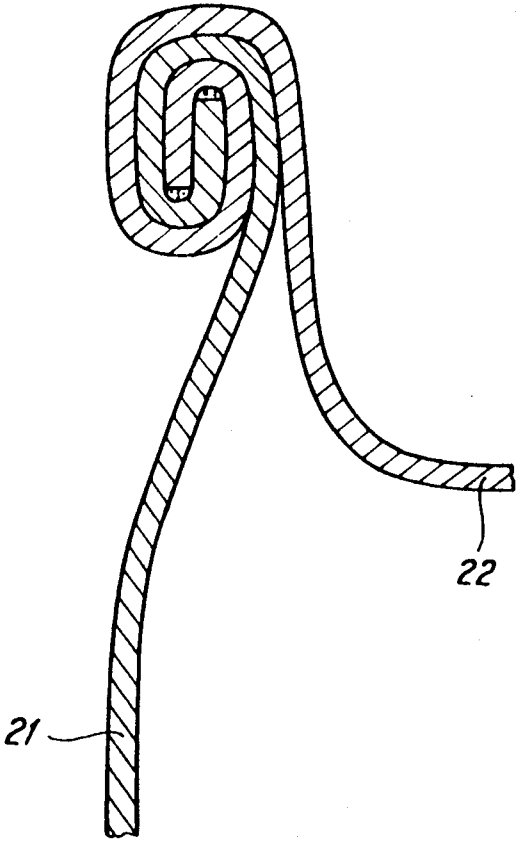
Figure 7B:
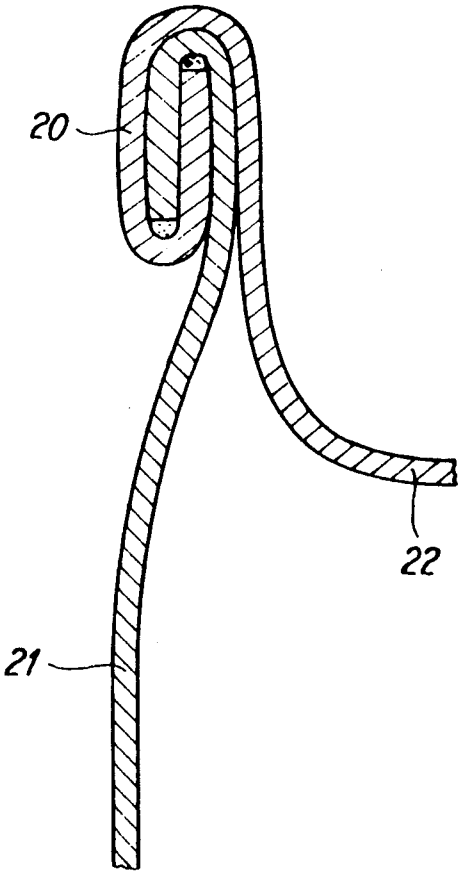
Figure 7A:
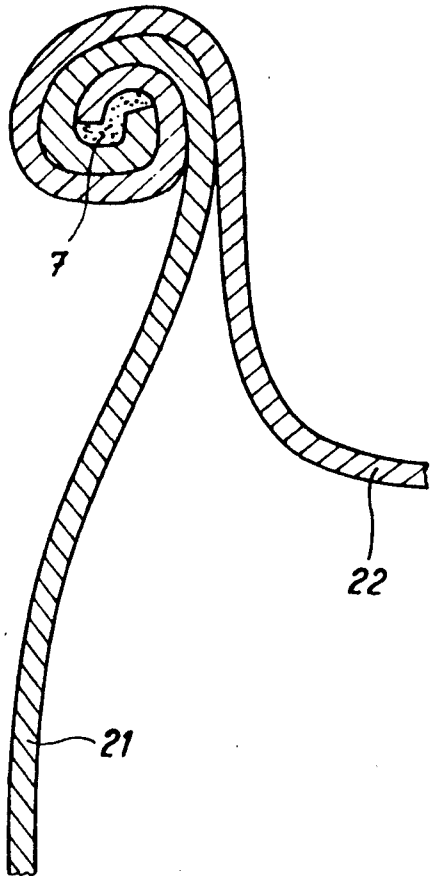

In FIGS. 7*a* and c an embodiment is shown of a triple seam or seam connection with seven layers respectively, in which the diameter of the outer edge of the seam is substantially equal or a little bit smaller than the outer diameter of the body.

FIG. 7*b* shows a seam connection which is completely moved inwardly radially as well. This is a so called double seam 20 between a body 21 and an end wall 22. Said double seam, which in the last phase of the seaming operation, is radially crushed flat, has an outer diameter which is smaller than the diameter of the body and can be obtained by applying flange dimensions which are a little bit different then necessary for a triple seam.

In FIG. 8 an alternative of the embodiment of FIG. 7*a* is shown in which case a seaming roller 14' is applied which with a surface 18 further presses inwardly the body wall, as shown at 19. In this manner it is achieved that the opening between the body and the upstanding portion of the end wall does not show a larger opening than with the known conventional seaming methods.

With the embodiments shown in FIGS. 9 to 12 incl. the container body 12 through the curved transition 21 has a flat flange 22. The end wall 23 has an upstanding edge 24, having the form of a conical sleeve which merges into the flat flange 25 with the open precurl 26 within which a seaming material is present at 27 and 28.

Different from other examples now the conically shaped upstanding edge 24 is supported over part of its height by a conically shaped support 29 which upwardly or outwardly merges into a cylindrical surface 30 and has a lower surface 31 which is at a distance from the end wall 23. Said lower edge 31 also can be at a higher level as indicated at 31'.

Figure 10:
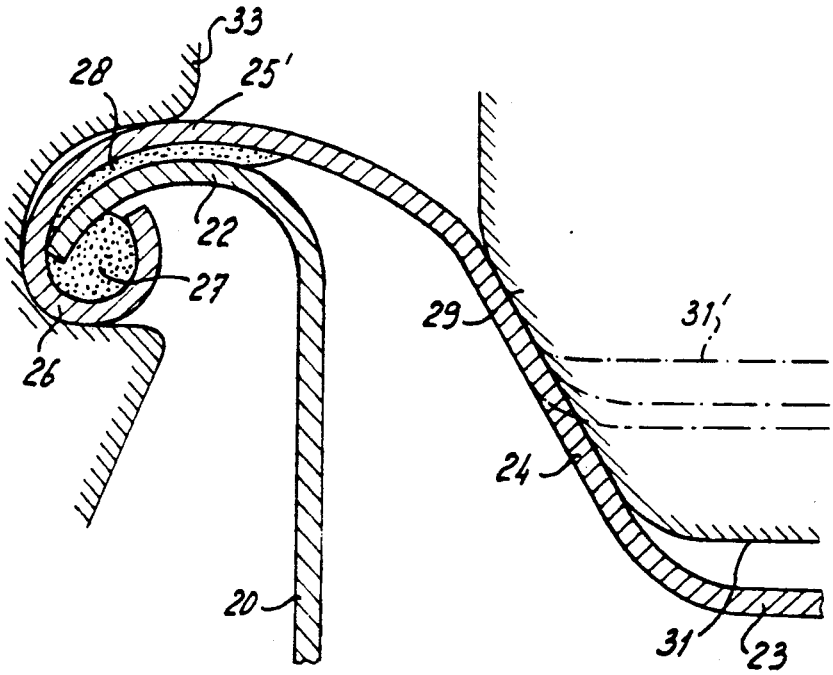

If seaming starts with said embodiment then the shape shown in FIG. 10 is generated rataher fast in which the flat flange 25 forms the cat's back 25' and in which the outer edge of the flange 22 enters into the curl 26 and therewith divides the sealing material into two portions.

Figure 11:
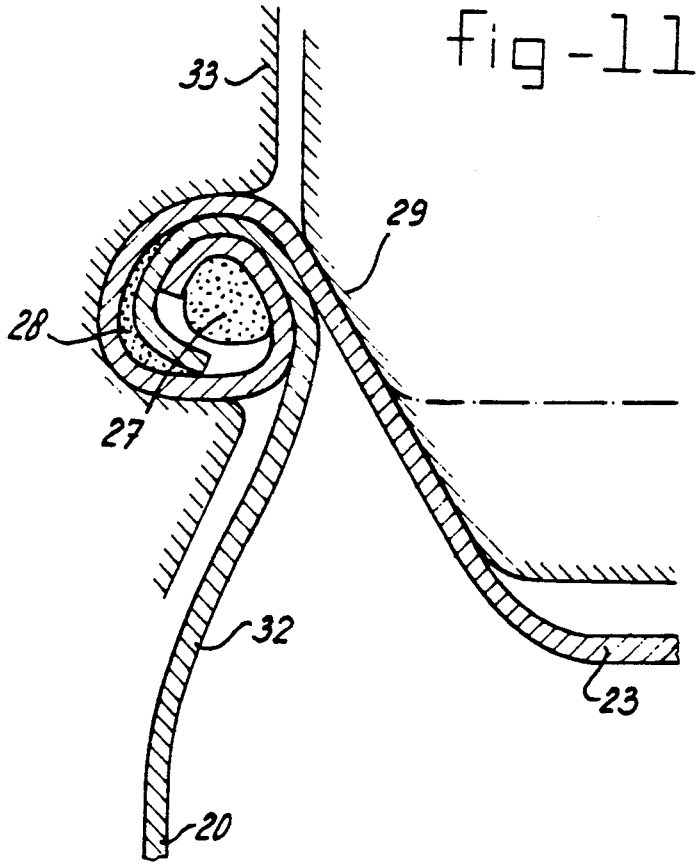

FIG. 11 shows the final situation of the first phase of the seaming operation.

Figure 12:
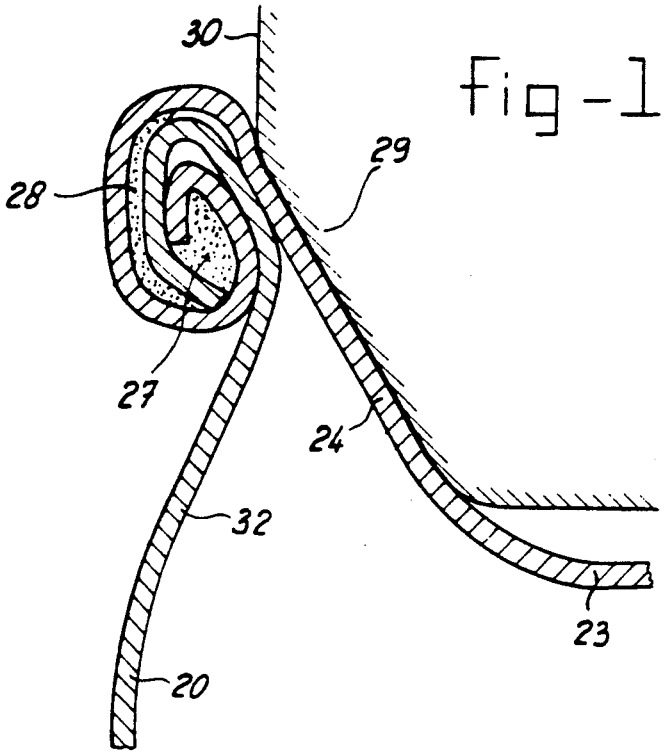

FIG. 12 shows the finally obtained form, which is obtained by pressing by means of a second seaming roller of a different profile the not yet engaging body and end wall flange, shown in FIG. 11, tight upon each other to obtain the desired sealing. With said embodiment the distance between the body 20 and the upstanding edge 24 is large, so that at the end of the seaming operation, as shown in FIG. 12, a seam is obtained, which with a conically shaped transition merges into the end wall in correspondence with the shape of the support 29, 30 and which has an oppositely shaped conical end edge of the body as shown at 32.

Figure 9:
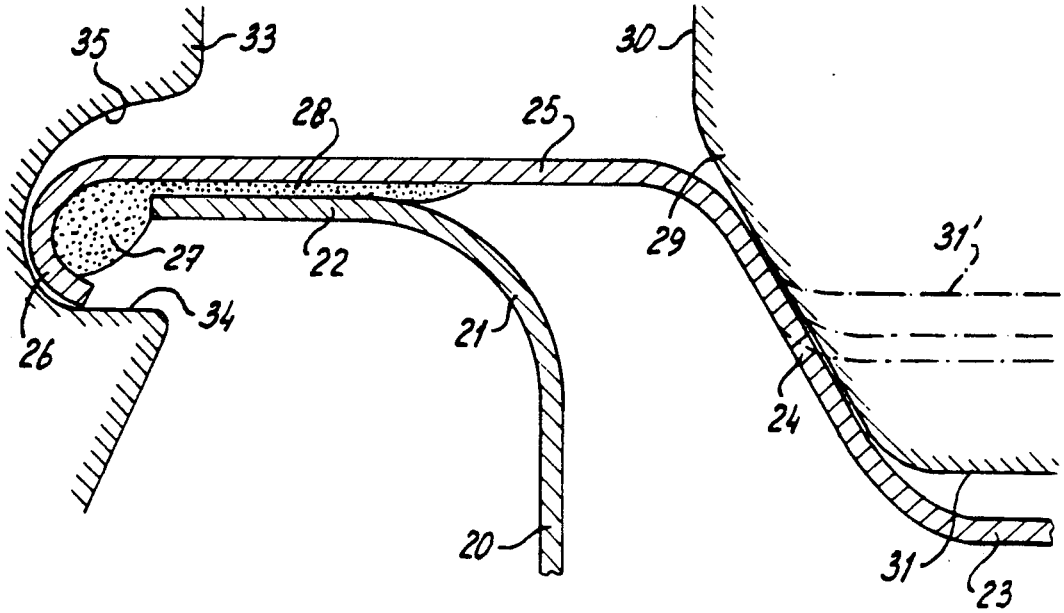

In FIGS. 9 to 11 the seaming roller for the first operational phase is diagrammatically indicated at 33. With said embodiment as well the precurl enters the lower part 34 of the groove 35 shown in the drawings, due to which the cat's back may formed as shown in FIG. 9.

Figure 13:
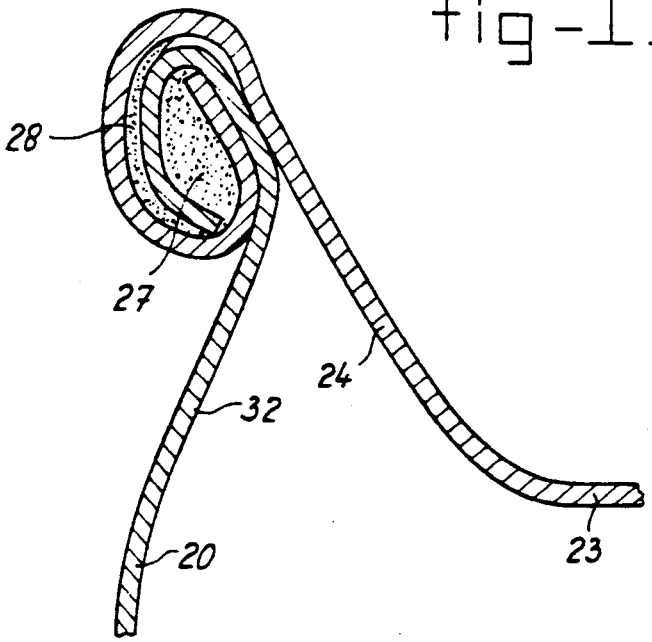

FIG. 13 shows an alternative of the embodiment of FIG. 12, which shows an intermediate form between a triple and a double seam connection.

With the embodiment shown in FIGS. 14 and 15 the support 37 has a central conically shaped hollow 38, into which fits a bulge 39 of the end wall 40 and is centered thereby. The end wall 40 at 41 at a sharp angle $\alpha$ merges into a obliquely outwardly extending end wall flange 42, having at the outer end a precurl 43, which in this case is very open. Said shape of the end wall has as advantage, that the end wall can be manufactured in one pressing operation and that the precurl operation applied with known manufacturing methods no longer is necessary. Herewith as well the precurl enters into the lower part 44 of the groove and the cat's back is formed in that the material bulges between the corner 41 and the precurl 43.

The seam connection shown in FIG. 15 then is formed, which at the inner side engages the conically shaped portion 45 of the support, the outer diameter of which lies within the outer diameter of the body 47, which seam connection may have the shape of the seam connection shown in FIG. 13 as well.

Figure 16:
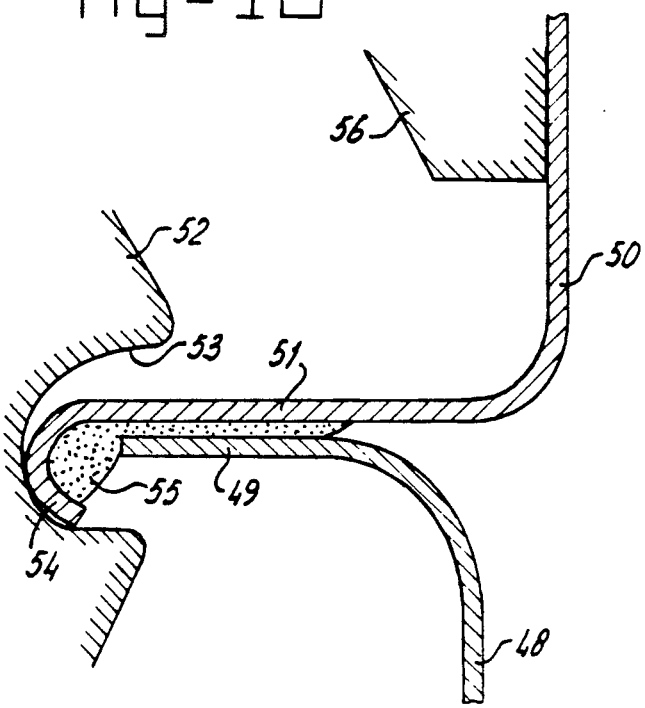
Figure 17:
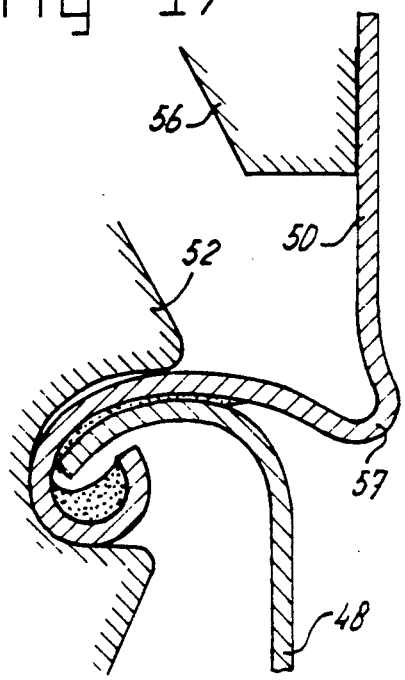
Figure 18:
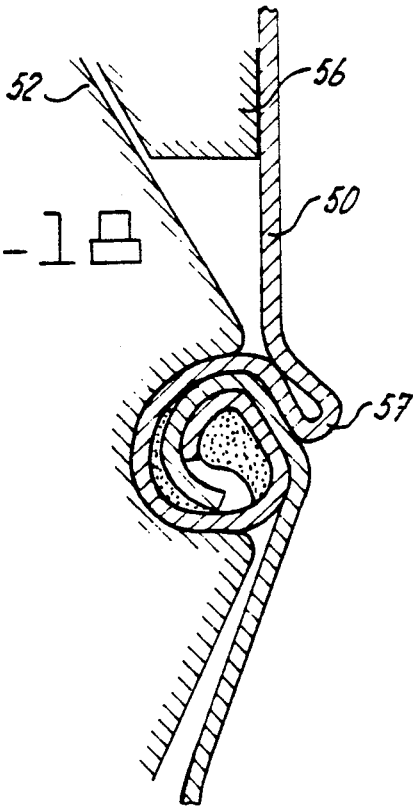

The embodiment according to FIGS. 16 to 18 incl. concerns a container comprising a body 48 with flange 49 and an end wall or cover 50 of which the upstanding edge and flange 51 is shown only but not the end wall itself, which end wall may have a shape promoting the flowing off of rain water from the upper end wall.

The seaming roller is indicated at 52 with a groove 53 and the flange 51 again has a precurl 54 with sealing material 55.

With said embodiment the upstanding edge 50 of the end wall is supported by an annular support 56 which engages the outer surface and which, to offer place to the seaming roller, is present at a distance from the flange 51.

By the fact that with said embodiment the precurl 54 enters the lower part of the groove as well as the bulge or cat's back may be formed, a pleat will be formed at 57 during inwardly rolling as shown in FIG. 17 and by the fact that the support 56 is at a distance from the flange 51, which pleat starts to function as a flange which resists further radial displacement inwardly and accordingly forms a support for the seam connection to be manufactured finally as shown in FIG. 18.

Figure 19:
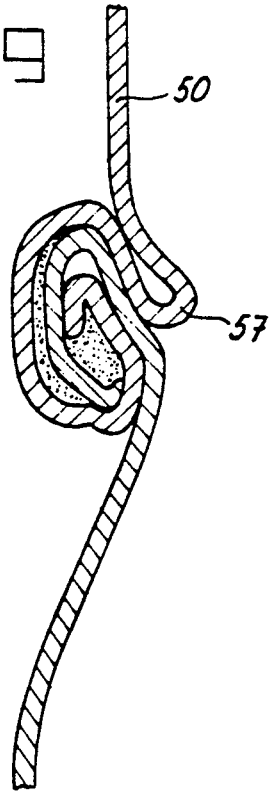

Herewith a seam connection is possible as well as shown in FIG. 19 the outer diameter of which is equal to or smaller than the outer diameter of the body or extends outwardly only a little bit.

With all embodiments the essence is based on the fact that the precurl enters the groove of the seaming roller such that a bulging or cat's back can be formed, due to which the material is displaced in axial direction during radial rolling into each other. By applying a support of the end wall located further inwardly a seam is obtained the diameter of which is reduced and accordingly extends outside the diameter of the body only a little bit or not.

I claim:

1. In a method of manufacturing a seam connection, between and edge of a radially outwardly extending flange (9) at one end of a body (1) of a metal container which is a figure of revolution having an axis, and an edge flange (5) of a metal end closure wall (2), in which said edge flange (5) is provided with a precurl (6) with a small radius, the inner diameter of said precurl (6) being larger than the thickness of the end edge (11) of said extending flange (9), which extending flange (9) at the location of a transition (10) toward the body (1) has a curvature having a radius of a magnitude such that a gradual bend transition is obtained from the body (1) toward said extending flange (9) and said edge flange (5) of said end closure wall (2) merges into said end closure wall (2) by a curvature (4), which edge and extending flanges (5, 9) after placing and axially pressing said end closure wall (2) and said body (1) upon each other are rolled into each other with the aid of at least one seaming roller (14) having a groove (15), which roller (14) is displaced in circumferential direction with respect to said body (1) and radially toward the body (1) to perform the rolling into each other of said edge and extending flanges (5, 9) inside said groove (15) of said seaming roller (14) with simultaneous centering and supporting of said end closure wall (2) on the inner side of said edge flange (5) of said end closure wall (2), said groove (15) of said seaming roller (14) having a height (K), which is larger than a thickness (V) of said precurl (6) measured in a direction parallel to said axis;

the improvement wherein an upstanding edge (3) of said end closure wall (2) and said transition (10) between said body (1) and said extending flange (9) are entirely spaced apart from each other, and wherein said precurl (6) at the beginning of the seaming operation is guided into that portion of said groove (15) of said seaming roller (14) which, seen in axial direction, is closer to the other end of said body (1), and wherein it is an underside (12) of said precurl (6) which first comes into contact with said portion of said groove (15).

2. Method according to claim 1, wherein during seaming, said end closure wall (2) is supported by a surface (13) extending around the axis of said body the largest diameter of which is smaller than the diameter of the body (1) to an extent such that a reduction of the diameter of the body takes place adjacent to the seam.

3. Method according to claim 1, wherein the edge flange (5) is precurled such that it is practically closed.

4. Method according to claim 3, wherein the outer diameter of the body flange (5) corresponds with the inner diameter of the precurl of the edge wall flange such that said edge wall flange and body flange can be centered upon each other.

5. Method according to claim 1, wherein a conical sleeve surface (24) is given to said upstanding edge and a support surface (29) for said conical sleeve surface (24) has a corresponding conical shape and only a part of the height of the sleeve surface engages said support surface (29).

6. Method according to claim 1, wherein said depth (D) of said upstanding edge of said end wall is defined by said height (H) of said upstanding edge to be achieved less a height (K) of said groove of said seaming roller and plus a thickness (V) of said precurl according to the formuia $$D=H-K+V.$$

7. Method according to claim 1, wherein a conically shaped central bulge (39) is given to said end wall which fits into a corresponding hollow (38) of a support for said end closure wall and said upstanding edge of said end closure wall joins said end closure wall at a an acute angle with a radial plane of said end closure wall and wherein said extending flange is directed parallel thereto prior to starting seaming.

* * * * *